US005308521A

United States Patent [19]

Pavilon et al.

[11] Patent Number: 5,308,521

[45] Date of Patent: May 3, 1994

[54] LUBRICANT WITH IMPROVED ANTI-CORROSION PROPERTIES

[75] Inventors: Thomas B. Pavilon, Cleveland Heights; Brent R. Dohner, Concord Township, Cuyahoga County; Jerry L. Rutter, Mentor, all of Ohio

[73] Assignee: The Lubrizol Corporation, Wickliffe, Ohio

[21] Appl. No.: 128,390

[22] Filed: Sep. 28, 1993

Related U.S. Application Data

[63] Continuation of Ser. No. 910,490, Jul. 8, 1992, abandoned.

[51] Int. Cl.[5] ..... C10M 133/44; C10M 155/00

[52] U.S. Cl. ..... 252/49.6; 252/50; 252/51.5 R

[58] Field of Search ..... 252/50, 49.6

[56] References Cited

U.S. PATENT DOCUMENTS

| | | | |
|---|---|---|---|
| 3,087,936 | 4/1963 | LeSuer | 260/326.3 |
| 4,426,305 | 1/1984 | Malec | 252/49.6 |
| 4,464,276 | 8/1984 | Sung et al. | 252/42.7 |
| 4,519,928 | 5/1985 | Braid | 252/50 |
| 4,522,785 | 6/1985 | D'Errico | 422/12 |
| 4,581,150 | 4/1986 | Horodysky et al. | 252/50 |
| 4,701,273 | 10/1987 | Brady et al. | 252/32.5 |
| 4,855,074 | 8/1989 | Papay et al. | 252/51.5 |
| 4,948,524 | 8/1990 | Kapuscinski et al. | 252/51.5 |
| 4,997,585 | 3/1991 | Frankenfeld et al. | 252/50 |
| 5,049,293 | 9/1991 | Blain et al. | 252/49.6 |
| 5,076,946 | 12/1991 | Frankenfeld et al. | 252/50 |
| 5,110,488 | 5/1992 | Tipton | 252/32.7 |
| 5,143,634 | 9/1992 | Quinga et al. | 252/50 |

FOREIGN PATENT DOCUMENTS

| | | |
|---|---|---|
| 0167295 | 1/1986 | European Pat. Off. . |
| 4-11694 | 1/1992 | Japan . |
| 1061904 | 3/1967 | United Kingdom . |
| 2024855 | 1/1990 | United Kingdom . |

OTHER PUBLICATIONS

Tetrahedron 47, pp. 2683-2372, 1991, "Benzotriazole: A Novel Synthetic Auxiliary," A. R. Katritsky et al.

*Primary Examiner*—Ellen M. McAvoy
*Attorney, Agent, or Firm*—David M. Shold

[57] ABSTRACT

An additive composition of (a) a substituted aromatic triazole and (b) a hydrocarbyl substituted succinic acylated polyamine dispersant, reacted with a boron compound, imparts improved corrosion resistance to lubricating oils which contain a multifunctional olefin copolymer viscosity index modifier.

31 Claims, No Drawings

LUBRICANT WITH IMPROVED ANTI-CORROSION PROPERTIES

This is a continuation of copending application Ser. No. 07/919,490, filed on Jul. 8, 1992, now abandoned.

BACKGROUND OF THE INVENTION

The present invention relates to a lubricant composition having improved performance properties.

Lubricant compositions such as motor oils have been the subject of much research to improve their physical and chemical properties. For instance viscosity index modifiers, which are generally polymers, have been used for many years to provide oils with useful viscosity at both high and low operating temperatures. New and improved VI modifiers are continually being introduced. There are also corrosion inhibitors which are used in lubricants in order to prevent damage to the lubricated parts, particularly when they are subjected to corrosive byproducts of combustion. In many instances these and other lubricant additives interact with each other in ways which are not predictable. Thus the use of certain VI modifiers, especially nitrogen-containing dispersant VI improvers, can result in increased corrosion when used with ordinary corrosion inhibitor compositions. Now, however, a corrosion inhibition package has been found which leads to improved corrosion properties when these selected VI modifiers are employed.

U.S. Pat. No. 3,087,936, LeSuer, Apr. 30, 1963, discloses the reaction product of an aliphatic olefin-polymer-succinic acid producing compound with an amine and reacting the resulting product with a boron compound. The composition is useful as an additive in lubricants.

U.S. Pat. No. 4,522,785, D'Errico, Jun. 11, 1985, discloses dialkylaminomethyl aromatic triazoles as corrosion inhibitors.

U.S. Pat. No. 5,049,293, Blain et al., Sept. 17, 1991, discloses an additive for lubricant or fuel composition comprising the boronated reaction product of polyalkenyl substituted succinimides, aldehydes and triazoles. The substituted succinimide, aldehyde, and triazole are reacted at 100°-200° C. at ambient pressure. The reaction product is then borated by reaction with e.g. boric acid.

U.S. Pat. No. 4,948,542, Kapuscincki et al., Aug. 14, 1990, discloses a dispersant anti-oxidant VI improver for a lubricating oil composition. The additive is prepared by reacting a polymer prepared from ethylene and at least one $C_3$–$C_{10}$ alpha-monoolefin with a nitrosodiphenylamine compound.

SUMMARY OF THE INVENTION

The present invention provides a lubricant composition comprising a major proportion of an oil of lubricating viscosity, a minor proportion of a multifunctional olefin copolymer viscosity index modifier and a minor proportion of an additive composition comprising (a) an aromatic triazole and (b) the reaction product of a hydrocarbylsubstituted acylating agent, a polyamine, and boron compound.

DETAILED DESCRIPTION OF THE INVENTION

The oil of lubricating viscosity. The first and major component of this invention is an oil of lubricating viscosity, including natural or synthetic lubricating oils and mixtures thereof. Natural oils include animal oils, vegetable oils, mineral lubricating oils of paraffinic, naphthenic, or mixed types, solvent or acid treated mineral oils, and oils derived from coal or shale. Synthetic lubricating oils include hydrocarbon oils, halo-substituted hydrocarbon oils, alkylene oxide polymers (including those made by polymerization of ethylene oxide or propylene oxide), esters of dicarboxylic acids and a variety of alcohols including polyols, esters of monocarboxylic acids and polyols, esters of phosphorus-containing acids, polymeric tetrahydrofurans, and silicon-based oils (including siloxane oils and silicate oils). Included are unrefined, refined, and rerefined oils. Specific examples of the oils of lubricating viscosity are described in U.S. Pat. No. 4,326,972.

The lubricating oil in the invention will normally comprise the major amount of the composition. Thus it will normally be at least 50% by weight of the composition, preferably about 83 to about 98%, and most preferably about 88 to about 90%. As an alternative embodiment, however, the present invention can provide an additive concentrate in which the oil can be 0 to about 20% by weight, preferably about 1 to about 10%, and the other components, described in more detail below, are proportionately increased.

The viscosity index modifier. A second component of the present invention is a multifunctional olefin copolymer viscosity index modifier, which is present in a minor amount. This material is normally present in an amount of about 0.1 to about 15 percent by weight in the final lubricant composition, preferably in an amount of about 0.5 to about 10 weight percent, and more preferably about 1 to about 5 percent by weight. This material, as all of the materials of the present invention, may be provided in a form which contains a certain proportion of diluent oil or other inert material for ease of handling. If this is the case the total amount of material should be adjusted accordingly in order to provide the desired amount of the active component.

The multifunctional olefin copolymer viscosity index modifier is one or a mixture of polymers which perform several functions. They serve first as a viscosity index ("VI") modifier, sometimes referred to as a viscosity index improver. This is the well-known function of controlling the rate or amount of viscosity change of a lubricant as a function of temperature. These are materials which have comparatively little thickening effect at low temperatures but significant thickening at high temperatures. This behavior extends the temperature range over which a lubricant can be used.

The VI modifiers for which the present invention is particularly useful further contain functional groups which provide dispersant and antioxidant functionality to the lubricant composition. Dispersant functionality serves to prevent particulate contamination in an oil or other lubricant from agglomerating into larger particles which can settle out as sludge or varnish. Antioxidant functionality is that which prevents atmospheric oxygen from interacting with the lubricant, particularly under conditions of high temperature and agitation. Such functionality retards thickening of the lubricant and the buildup of acidity due to oxidation. Although separate dispersant and antioxidant additives may also be used, the presence of one or more comonomers on the VI modifier entity which serve this function is often desirable.

The VI modifiers which are of particular interest for the present invention are graft-modified amine-containing olefin copolymers. The olefin copolymers are preferably copolymers of ethylene with an alpha olefin such as butene, pentene, hexene, and so on up through about $C_{12}$ alpha olefins, and most preferably propylene. The amount of ethylene copolymer in the polymeric chain is preferably about 35 to about 90 mole percent, more preferably about 40 to about 80 mole percent, and the viscosity average molecular weight of the polymer is preferably about 5,000 to about 500,000, more preferably about 150,000 to about 300,000.

The olefin copolymer is modified by incorporating amine functionality by a grafting reaction. The grafting reaction can be by a well-known free radical grafting reaction, wherein a radical source such as dicumyl peroxide can, for example, extract a hydrogen atom from the polymer chain, leaving a free radical. The radical on the chain can interact with a point of ethylenic unsaturation in a graft comonomer and lead to addition of the comonomer to the chain. Alternatively grafting can occur by an "ene" reaction whereby an unsaturated comonomer reacts with a site of unsaturation on the polymer chain via a cyclic reaction to result in grafting of the monomer. The site of unsaturation on the copolymer chain can be a byproduct of the initial polymerization reaction or it can be introduced intentionally by copolymerization with a diene such as 1,3-butadiene or norbornadiene. Other monomers may be present if desired, and the polymer can also be treated by partial oxidation or other means, if desired, to increase the number of reactive sites.

Other methods of grafting can also be employed such as ionic grafting reactions or reactions whereby a grafted comonomer itself contains a further reactive site. The reactive site then is finally reacted with a second monomer which provides the actual desired antioxidant and dispersant functionality to the VI modifier.

Examples of monomers suitable for grafting include reactive monomers such as aminopropylene, maleic anhydride or other ethylenically unsaturated acylating monomers, para-chloromethylstyrene, ethyl isocyanate, glycidyl methacrylate, or isocyanatoethyl methacrylate, which are in turn reacted with and linked to functional compounds such as methioaniline, 4-aminodiphenylamine, N-aryl-p-phenylenediamines such as N-phenyl-para-phenylenediamine, amino carbazoles, aminoindoles, aminoindazolinones, amino mercaptotriazoles, aminotetrazoles, aminothiazoles, aminobenzothiazoles, aminoalkylthiazoles, aminopyrroles, aminopyrimidines, optionally with alkyl substituents, and homologues thereof. Further examples of this class of polymer are disclosed in U.S. Pat. Nos. 5,075,383 and 4,863,623 and European publication 461774. Linkage can also be effected by reacting an oxidized polymer with a source of formaldehyde and an aromatic polyamine, as disclosed in European publication 470698 or by reacting a grafted epoxy-containing monomer with a Mannich base formed from an aldehyde, a polyamine, and a phenol, as disclosed in U.S. Pat. No. 4,904,404. Other functional monomers may be grafted directly onto the polymeric chain, including alkyl methacrylamides, vinylpyridine, nitrosodiphenylamines, phenothiazine, N-vinylpyrrolidinone, 1-vinyl-2-pyrrolidinone, 5-methyl-6-vinyl 1,2,4-thiazine, 4-methyl-5-vinylthiazole, alkyl substituted materials of this type, and homologues thereof. A preferred polymer of this type is disclosed in U.S. Pat. No. 4,948,524.

One such polymeric viscosity modifier is provided by Texaco Chemical Company, under the trade name TLA 7700 TM. This material contains as its active ingredient an ethylene-propylene copolymer grafted with an amine-containing comonomer or functionality which provides antioxidant and dispersant properties. (The material as supplied also contains diluent oil, which is excluded from calculations.) It is believed that the amine functionality is provided by a grafted comonomer which is nitrosodiphenylamine. As is the case with many lubricant additives, however, this and other related materials under certain test conditions exhibit certain deleterious properties for which compensation must be made in one way or another. It has been found that when this multifunctional amine-grafted olefin copolymer viscosity modifier is incorporated into oils for use as automotive engine lubricants, and when a traditional additive package is used therewith, the corrosion of the lubricant towards copper-lead bearings, as measured by the "L-38" test, increases to unacceptable levels. The L-38 test is a test for measurement of oxidation stability and bearing corrosion characteristic of engine crankcase oils. The test involves operation of a single cylinder spark injection engine for 40 hours, followed by evaluation of the weight loss of the copper-lead connecting rod bearing. This test is described in more detail in "Lubricant Additives", C. V. Smalheer and R. Kennedy Smith (Lesius-Hiles Company Publishers, Cleveland, Ohio, 1967) page 51, and further set forth in U.S. Federal Test Method Standard No. 791a. The reason for this increase in corrosion when the above VI modifier is used is not known but is believed to be due to the chemical nature of the substituent groups on the polymer chain or to particular additives or residual chemicals from processes used to prepared the graft copolymer. The present invention provides a combination of additives which reduces the corrosive nature of lubricating oils which contain such multifunctional VI modifiers so that properly formulated lubricating compositions can pass industry tests such as the L-38 test.

The triazole (a). The first component of the additive combination of the present invention is (a) an aromatic triazole. A wide variety of aromatic triazoles are known, many of which are described in detail in "Benzotriazole: A Novel Synthetic Auxiliary," Katritsky, Rachwal and Hitchings, *Tetrahedron, Vol* 47, No 16/17, pp 2683–2732, 1991 (Pergamon Press plc), along with methods for their preparation.

It is preferred that the triazole be a substituted benzotriazole, in order that the solubility of the material in lubricating oil be sufficient to provide easy preparation, storage, and use of the composition. Thus it is preferred that the triazole contain a hydrocarbyl substituent. The location of the substitution is not critical. In one embodiment the substitution is on the benzene ring. In this case there may be 1 through 4 hydrocarbyl substituents, but most commonly there will be a single hydrocarbyl substituent. It is preferred that the hydrocarbyl substituent be an alkyl, aryl, or aralkyl substituent, and most commonly it will be an alkyl group. Alkyl groups include groups from methyl up to long chain alkyl groups such as alkyl oligomers or polymers, including ethyl, propyl, butyl, amyl, hexyl, and octyl groups, both normal and branched, as well as longer carbon chains such as $C_{12}$ to $C_{24}$, including $C_{18}$, which may be saturated or unsaturated. Examples of suitable aromatic triazoles are benzotriazole, alkyl-substituted benzotriazole (e.g., tolyltriazole, ethylbenzotriazole,hexylbenzotriazole,octylbenzotriazole, etc.), aryl-substituted benzotriazole (e.g., phenol benzotriazoles, etc.), and alkylaryl- or arylalkyl-substituted benzotriazole and substituted benzotriazoles where the substituent may be hydroxy, alkoxy, halo (especially chloro), nitro, carboxy and carboxyalkoxy. Preferably, the triazole is a benzotriazole or an alkylbenzotriazole in which the alkyl group contains 1 to about 20 carbon atoms, preferably 1 to about 8 carbon atoms. Benzotriazole and tolyltriazole are particularly preferred.

In another embodiment there is substitution on at least one of the nitrogen atoms of the triazole group. One such type of substitution is the formation of a salt, preferably a salt of a benzotriazole anion and a quaternary ammonium cation. It is preferred, in order to impart additional hydrocarbon solubility to such a salt, that the quaternary ammonium cation be derived from an amine which contains at least one hydrocarbyl group as described above, preferably at least one alkyl group of at least 6 carbon atoms. Di-2-ethylhexylamine is a suitable amine for forming such a cation.

Alternatively, the substitution on one of the nitrogen atoms of the triazole can be accomplished by reacting a benzotriazole with an aldehyde and a primary or secondary amine or an alcohol. Numerous examples of such substituted triazoles are disclosed in the Katritzky reference mentioned above.

The aldehyde used in preparing this embodiment of component (a) can be alkyl, aryl, alkylaryl, or arylalkyl containing 1 to about 12 or more carbon atoms. Included are benzaldehyde, salicylaldehyde, and 2-ethylhexanal. If it desired that the aldehyde moiety itself be used to impart hydrocarbon solubility to the triazole, then the aldehyde should be selected to have a suitably large number of carbon atoms, such as at least 4 or preferably at least about 6. However, it is also possible that the primary or secondary amine or alcohol reactant will impart a large portion of the hydrocarbon solubility to the molecule. In that case lower molecular weight aldehydes can be conveniently used. Formaldehyde and paraformaldehyde are preferred.

The amine used in the preparation of this embodiment of component (a) can be one or more mono or polyamines. These monoamines and polyamines can be primary amines or preferably secondary amines. (It is believed that tertiary amines may also be used if the desired product is a quaternary salt rather than a covalent structure.)

The monoamines generally contain from 1 to about 24 carbon atoms, with 1 to about 12 carbon atoms being more preferred, with 1 to about 6 being more preferred. Examples of monoamines useful in the present invention include methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. The polyamines may be aliphatic, cycloaliphatic, heterocyclic or aromatic. Examples of the polyamines include alkylene polyamines and heterocyclic polyamines.

Alkylene polyamines are represented by the formula

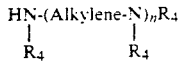

wherein n has an average value between about 1 and about 10, preferably about 2 to about 7 and the "Alkylene" group has from 1 to about 10 carbon atoms, preferably about 2 to about 6. $R_4$ is independently hydrogen or hydrocarbyl, but preferably an aliphatic or hydroxy-substituted aliphatic group of up to about 30 carbon atoms.

Such alkylene polyamines include methylene polyamines, ethylene polyamines, butylene polyamines, propylene polyamines, pentylene polyamines, etc. The higher homologs and related heterocyclic amines such as piperazines and N-amino alkyl-substituted piperazines are also included. Specific examples of such polyamines are ethylene diamine, diethylene triamine (DETA), triethylene tetramine (TETA), tris-(2-aminoethyl)amine, propylene diamine, trimethylene diamine, tripropylene tetramine, tetraethylene pentamine (TEPA), hexaethylene heptamine, pentaethylenehexamine, etc.

Higher homologs obtained by condensing two or more of the above-noted alkylene amines are similarly useful as are mixtures of two or more of the aforedescribed polyamines.

Ethylene polyamines, such as some of those mentioned above, are useful. Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as piperazines. Ethylene polyamine mixtures are useful.

The amine may also be a heterocyclic polyamine. Among the heterocyclic polyamines are aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkylsubstituted piperidines, piperazine, aminoalkylsubstituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% (by weight) material boiling below about 200° C. A typical sample of such ethylene polyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogues of diethylenetriamine, triethylenetetramine and the like.

Another useful polyamine is a condensation reaction between at least one hydroxy compound with at least one polyamine reactant containing at least one primary or secondary amino group. The hydroxy compounds are preferably polyhydric alcohols containing from 2 to about 10, preferably 2 to about 6, preferably 2 to about 4 hydroxyl groups and up to 40 aliphatic carbon atoms, preferably from 2 to about 30, more preferably 2 to about 10. The polyhydric alcohols include ethylene glycols, propylene glycols, glycerol, butane diol, hexane diol, sorbitol, arabitol, mannitol, sucrose, fructose, glucose, cyclohexane diol, erythritol, and pentaerythritols. Preferably the hydroxy compounds are polyhydric amines, which include any of the above-described monoamines reacted with an alkylene oxide. Examples of polyhydric amines include tri-(hydroxypropyl)amine, tris-(hydroxymethyl)amino methane, 2-amino-2-methyl-1,3-propanediol, N,N,N,'N'-tetrakis(2-hydroxypropyl)ethylenedicamine, and N,N,N,'N'-tetrakis(2-hydroxyethyl) ethylenediamine,preferablytris(hydroxymethyl)aminomethane (THAM).

Suitable polyamine reactants include triethylenetetramine (TETA), tetraethylenepentamine (TEPA), pentaethylenehexamine (PEHA), and mixtures of polyamines such as the above-described "amine bottoms".

Likewise, in place of an amine an alcohol can be used to form the reaction product with the triazole and the aldehyde. Suitable alcohols include straight chain and branched alcohols and may include alkyl carbon chains and carbon chains which including aromatic rings or heteroatoms such as oxygen or nitrogen. Preferred alcohols are those containing from 3 or especially about 4 to about 24 carbon atoms, including propyl alcohol, butyl alcohol, amyl alcohol, hexyl alcohols such as 4-methyl-2-pentanol, octyl alcohols such as 2-ethylhexanol, and decyl alcohols. Use of alcohols of 6 or more carbon atoms is particularly preferred because such materials impart superior oil solubility to the substituted triazole. Primary alcohols are the most reactive and thus the most suitable for preparation of such products; secondary and tertiary alcohols would be expected to be comparatively unreactive.

A preferred material of component (a) is represented by the formula:

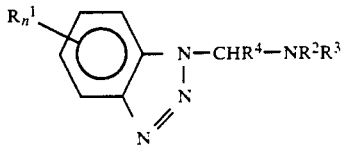

In this formula $R^1$ is a hydrocarbyl group, and n is 0 to 4, provided that if n is greater than 1 not all such hydrocarbyl groups need be identical. Most preferably n=1 and $R_1$ is methyl, so that the triazole is tolyltriazole.

In the above formula $R^2$ and $R^3$ are hydrogen or alkyl, provided that $R^2$ and $R^3$ are not both hydrogen. That is, the $NR_2R_3$ group represents a primary or secondary amine residue, but not ammonia. In a preferred embodiment $R_2$ and $R_3$ are both 2-ethylhexyl, that is, the amine is di-2-ethylhexylamine.

In the above formula $R^4$ is a hydrogen atom or an alkyl group of 1 to about 6 carbon atoms. The $CHR^4$ group corresponds to an aldehyde residue which can be used in the preparation of the preferred material by a condensation process, described below. It is preferred that the aldehyde is formaldehyde or an equivalent form thereof, in which case the $CHR^4$ group is $CH_2$.

The above adduct described for component (a) is prepared by mixing the triazole and the amine in a suitable inert solvent and optionally water, and cooling the mixture in an ice bath. The aldehyde is conveniently added as an aqueous solution in a dropwise manner into the cooled mixture. It is generally preferable to use a slight stoichiometric excess (usually about 10 to 20% excess) of the aldehyde and the amine. The reaction is very thermodynamically favorable, particularly when the aldehyde is formaldehyde or paraformaldehyde, and can be run at room temperature or less. However, heating to about 100° C. or higher can be desirable for removal of water of reaction.

The boronated dispersant (b). Component (b) of the present invention is the reaction product of a hydrocarbyl-substituted acylating agent, a polyamine, and a boron compound.

The hydrocarbyl-substituted acylating agents include succinic acylating agent, in particular succinic acids, halides, esters, and anhydrides, preferably acids, esters or anhydrides, and more preferably anhydrides. The hydrocarbyl group generally contains an average of at least about 8 to about 350, preferably about 30 to about 200, and more preferably about 35 to about 100 carbon atoms. In one embodiment, the hydrocarbyl group is derived from a polyalkene.

The polyalkene is characterized by an $\overline{M}n$ (number average molecular weight) of at least about 500. Generally, the polyalkene is characterized by an $\overline{M}n$ of about 500 to about 5000, preferably about 700 to about 2500, more preferably about 800 to about 2000, and even more preferably even about 900 to about 1500. In another embodiment $\overline{M}n$ varies between about 500, 700, or 800 up to about 1200 or 1300.

The polyalkenes include homopolymers and interpolymers of polymerizable olefin monomers of 2 to about 16 or to about 6, or to about 4 carbon atoms. The olefins may be monoolefins such as ethylene, propylene, 1-butene, isobutene, and 1-octene; or a polyolefinic monomer, including diolefinic monomers, such as 1,3-butadiene and isoprene. The preparation and use of substituted succinic acylating agents wherein the substituent is derived from such polyalkenes are described in U.S. Pat. No. 4,234,435.

In another embodiment, the succinic acylating agents are prepared by reacting the above described polyalkene with an excess of maleic anhydride to provide substituted succinic acylating agents wherein the number of succinic groups for each equivalent weight of substituent group is at least. 1.3, or to about 1.5, or to about 1.7, or to about 1.8. The maximum number generally will not exceed 4.5, or to about 2.5, or to about 2.1, or to about 2.0.

In another embodiment, the hydrocarbyl group contains an average from about 8, or about 10, or about 12 up to about 40, or to about 30, or to about 24, or to about 20 carbon atoms. In one embodiment, the hydrocarbyl group contains an average from about 16 to about 18 carbon atoms. In another embodiment, the hydrocarbyl group contains on average 3 to 4 monomer units wherein the monomer is isobutylene or isopropylene. In one such embodiment the hdyrocarbyl group is a tetrapropenyl group.

The succinic acylating agents are prepared by reacting the above-described olefins, isomerized olefins or oligomers thereof with unsaturated carboxylic acylating agents, such as itaconic, citraconic, or maleic acylating agents at a temperature of about 160°, or about 185° C. up to about 240° C., or to about 210° C. Maleic acylating agents are the preferred unsaturated acylating agent. The procedures for preparing the acylating agents are well known to those skilled in the art and have been described for example in U.S. Pat. No. 3,412,111; and Ben et al, "The Ene Reaction of Maleic Anhydride With Alkenes", J. C. S. Perkin II (1977), pages 535–537.

The amine which reacts with the succinic acylating agent may be any of the amines described above and is preferably a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

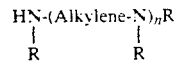

wherein n has an average value of 1 to about 10, preferably about 2 to about 7, or to about 5, and the "Alkylene" group has 1 to about 10, preferably about 2 to about 6, or to about 4 carbon atoms. Each R is independently hydrogen, or an aliphatic or hydroxy-substituted aliphatic group of up to about 30 carbon atoms. Such alkylenepolyamines include methylenepolyamines, ethylenepolyamines, butylenepolyamines, propylenepolyamines, pentylenepolyamines, etc. Ethylenepolyamine, also referred to as polyethyleneamine, is preferred. Such polyamines are most conveniently prepared by the reaction of ethylene dichloride with ammonia or by reaction of an ethylene imine with a ring opening reagent such as water, ammonia, etc.

The reaction products of hydrocarbyl-substituted succinic acylating agents and amines and methods for preparing the same are described for example in U.S. Pat. Nos. 4,234,435; 4,952,328; 4,938,881; 4,957,649; and 4,904,401. It is possible to react the hydrocarbyl-substituted acylating agent of the present invention with an amine which is incorporated as a part of a substituted triazole. Such a reaction leads to products in which the molecules of parts (a) and (b) are linked by sharing a common amine, and such materials are disclosed in U.S. Pat. No. 5,049,293. However for the present invention it is preferred that components (a) and (b) be separate molecules.

The reaction product of the hydrocarbyl-substituted succinic acylating agent and the amine is further treated with a boron compound. Suitable boron compounds include boron oxide, boron oxide hydrate, boron acids such as boronic acid (e.g. alkyl-$B(OH)_2$ or aryl-$B(OH)_2$, boric acid (i.e., $H_3BO3$) tetraboric acid (i.e., $H_2B_4O_7$), metaboric acid (i.e. $HBO_2$) and esters of such boron acids. Specific examples of boronic acids include methyl boronic acid, phenyl boronic acid, cyclohexyl boronic acid, p-heptylphenyl boronic acid, and dodecyl boronic acid.

The boron acid esters include especially mono-, di-, and tri-organic esters of boric acid with alcohols or phenols such as, e.g., methanol, ethanol, isopropanol, cyclohexanol, cyclopentanol, 1-octanol, 2-octanol, dodecand behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol, diethylene glycol, carbitol, Cellosolve TM, triethylene glycol, tripropylene glycol, phenol, naphthol, p-butylphenol, o,p-diheptylphenol, n-cyclohexylphenol, 2,2-bis-(p-hydroxyphenyl)propane, polyisobutene (molecular weight of 1500)-substituted phenol, ethylenechlorhydrin, o-chlorophenol, m-nitrophenol, 6-bromooctanol, and 7-ketodecanol. Lower alcohols, 1,2-glycols, and 1,3-glycols, i.e., those having fewer than about 8 carbon atoms are specially useful for preparing the boric acid esters for the purpose of this invention. Most preferably the boron compound is boric acid.

The reaction of the acylated nitrogen compositions with the boron compounds can be effected simply by mixing the reactants at the desired temperature. The use of an inert solvent is optional although it is often desirable, especially when a highly viscous or solid reactant is present in the reaction mixture. The inert solvent may be a hydrocarbon such as benzene, toluene, naphtha, cyclohexane, n-hexane, or mineral oil. The temperature of the reaction may be varied within wide ranges. Ordinarily it is preferably between about 50° C. and about 250° C. In some instances it may be 25° C. or even lower. The upper limit of the temperature is the decomposition point of the particular reaction mixture.

The reaction is usually complete within a short period such as 0.6 to 6 hours. After the reaction is complete, the product may be dissolved in the solvent and the resulting solution purified by centrifugation or filtration if it appears to be hazy or contain insoluble substances. Ordinarily the product is sufficiently pure that further purification is unnecessary or optional.

The relative proportions of the reactants to be used for preparation of the borated material are based primarily upon the consideration of utility of the products for the purposes of this invention. In this regard, useful products are obtained from reaction mixtures in which the reactants are present in relative proportions as to provide from about 0.1 atomic proportions boron for each mole of acylated nitrogen composition used to about 10 atomic proportions of boron for each atomic proportion of nitrogen of said acylated nitrogen composition used. The preferred amounts of reactants are such as to provide from about 0.5 atomic proportions of boron for each mole of the acylated nitrogen composition to about 2 atomic proportions of boron for each atomic proportion of nitrogen used. To illustrate, the amount of a boron compound having one boron atom per molecule to be used with one mole of any acylated nitrogen composition having five nitrogen atoms per molecule is within the range from about 0.1 to about 50 moles, preferably from about 0.5 to about 10 moles. It is preferred that the components of (b) are present in relative amounts of about 3–5 moles carbonyl group, about 2–8 moles amino group, and about 2–8 moles boric acid. It is more preferred that the relative amounts are about 3–5 moles carbonyl group, about 2–4 moles amino group, and about 2–4 moles boric acid. The preparation of such complexes is more fully described in U.S. Pat. No. 3,087,936.

The total amount of the additive combination (a) plus (b) in the composition is about 0.5 to about 10 weight percent. The relative amounts of components (a) and (b) are such that their weight ratio preferably falls in the range of about 1:3 to about 1:120, preferably about 1:12 to about 1:30. The amount of component (a) in the lubricating composition is generally about 0.001 to about 1, preferably about 0.01 to about 0.2 weight percent and more preferably about 0.03 to about 0.07 weight percent. The amount of component (b) in the lubricating composition is generally about 0.1 to about 5 weight percent, preferably about 0.3 to about 3 weight percent, and most preferably about 0.6 to about 1.5 weight percent. The amount of the functional VI modifier in the final composition is preferably about 0.1 to about 15 weight percent, preferably about 0.5 to about 10 weight percent, and most preferably about 1 to about 5 percent. The relative amounts of the viscosity index modifier and components (a) plus (b) are preferably about 1:2 to about 25:1.

As used herein, the term "hydrocarbyl substituent" or "hydrocarbyl group" means a group having a carbon atom directly attached to the remainder of the molecule and having predominantly hydrocarbon character. Such groups include hydrocarbon groups, substituted hydrocarbon groups, and hetero groups, that is, groups which, while primarily hydrocarbon in character, contain atoms other than carbon present in a chain or ring otherwise composed of carbon atoms.

Optional components. In addition to the above-described components, the compositions of the present invention will normally contain those additional additives which are well-known for use in lubricating compositions. The particular choice of additional additives will depend on the use desired, but may include one or more basic alkali or alkaline earth metal salts of acidic organic compounds (carboxylic acids, sulfonic acids, phosphonic acids, phenols, and so on). These salts are generally referred to as overbased materials. Overbased materials are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Such overbased materials are well known to those skilled in the art. Patents describing techniques for making basic salts of sulfonic acids, carboxylic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

The composition may also include a supplemental sulfur-, phosphorus-, or sulfur- and phosphorus-containing antiwear agent. The term antiwear agent is used to refer to compounds which provide wear protection properties to lubricating compositions and functional fluids. Antiwear agents are useful in controlling wear and may also act as extreme pressure agents and as antioxidants. These antiwear agents include sulfurized organic compounds, hydrocarbyl phosphates, phosphorus-containing amides, phosphorus-containing carboxylic esters, phosphorus-containing ethers, and dithiocarbamate-containing compounds. Examples of hydrocarbyl phosphates include hydrocarbyl thiophosphates. Thiophosphates may contain from one to about three sulfur atoms, preferably one or two sulfur atoms. Thiophosphates are prepared by reacting one or more phosphites with a sulfurizing agent including sulfur, sulfur halides, and sulfur containing compounds. Salts of thiophosphates include zinc dithiophosphates.

Other antioxidants, corrosion inhibitors, extreme pressure and anti-wear agents may also be used which include chlorinated aliphatic hydrocarbons; and molybdenum compounds.

Pour point depressants may also be included. They are a particularly useful type of additive often included in the lubricating oils described herein. See for example, page 8 of "Lubricant Additives" by C. V. Smalheer and R. Kennedy Smith (Lesius-Hiles Company Publishers, Cleveland, Ohio, 1967).

Anti-foam agents may be used to reduce or prevent the formation of stable foam and include silicones or organic polymers. Examples of these and additional anti-foam compositions are described in "Foam Control Agents", by Henry T. Kerner (Noyes Data Corporation, 1976), pages 125–162.

These and other additives which may be included are described in greater detail in U.S. Pat. No. 4,582,618 (column 14, line 52 through column 17, line 16, inclusive).

EXAMPLES

The following examples are prepared by mixing the individual components in the proportions indicated. The Examples which contain the additive mixture of (a) and (b) as specified hereinabove each provide superior corrosion resistance compared with similar compositions in which both components of the mixture are not present. Several of the fully formulated compositions (those containing a number of further additives) are capable of passing demanding industrial tests for corrosion resistance.

Compositions are prepared by combining:

EXAMPLE 1

(i) about 94 weight percent base lubricating oil;

(ii) 5 weight percent (based on active ingredient and excluding diluent oil) of an amine comonomer grafted ethylene/propylene viscosity index improver known as Texaco TM TLA 7700. This material is believed to have amine functionality provided by a graft comonomer of N-nitrosodiphenylamine and a molecular weight of about 200,000.

(a) 0.05 weight percent of the condensate of tolyltriazole with formaldehyde and di-2-ethylhexylamine in 1:1:1 mole ratios (available under the trade name Reomet TM 39);

(b) 1 weight percent of the borated product of polyisobutylene-substituted succinic anhydride reacted with polyethyleneamines, having a CO:N:B mole ratio of 4:3:3.

EXAMPLE 2

(i) about 97.4 weight percent base lubricating oil;

(ii) 2.5 weight percent of an amine comonomer grafted ethylene/propylene/hexadiene viscosity index improver having amine functionality provided by a graft comonomer of vinylpyridene;

(a) 0.001 weight percent of the condensate of benzotriazole with acetaldehyde and monoethylhexylamine in 1:1:1 mole ratios;

(b) 0.1 weight percent of the borated product of polypropylene-substituted succinic anhydride reacted with amine bottoms, having a CO:N:B mole ratio of 3:8:2, prepared by reacting the succinic compound with boric acid.

EXAMPLE 3

(i) about 98 weight percent of a combination of base lubricating oils (principally Texaco SNO-100 and 150);

(ii) 0.5 weight percent of an amine comonomer grafted ethylene/propylene viscosity index improver having amine functionality provided by a graft comonomer of phenothiazine;

(a) 0.05 weight percent of the salt of tolyltriazole anion with quaternary ammonium salt of diethylhexylamine;

(b) 1 weight percent of the borated product of propylene tetramer-substituted succinic anhydride reacted with polyethyleneamine having on average about 8 ethylene amine units, having a CO:N:B mole ratio of 5:2:8 and prepared by reacting the succinic derivative with isopropyl borate.

EXAMPLE 4

The components of Example 1, except that the viscosity index improver (ii) is replaced by an equal amount of an ethylene-butadiene copolymer grafted with 1-vinyl-2-pyrrolidone.

EXAMPLE 5

The components of Example 1, except that the viscosity index improver (ii) is replaced by an equal amount of an ethylene-propylene-norbornadiene copolymer (70:29:1 mole ratio) grafted with methyl methacrylamide.

EXAMPLE 6

The components of Example 1 and in addition (c) 2 weight percent of the calcium salt of sulfur coupled alkyl phenates, prepared from 4 equivalents propylene tetramer-substituted phenol and 3 equivalents sulfur or $SCl_2$ (about 1 part prepared using S and about 2 parts prepared using $SCl_2$), containing about 50% active ingredient and about 50% inert diluent oil, (d) 3.1 weight percent of the calcium overbased salt of branched chain monoalkyl sulfonates having a molecular weight of about 500 and a metal ratio of 11, about 50 weight percent active ingredient and about 50% diluent oil, and (e) 2.0 weight percent polyisobutylene succinimide from polyisobutylene (1 mole) and succinic anhydride (1.8 moles), molecular weight 2500, reacted with amine bottoms, CO:N mole ratio 1:1.

The amount of lubricating oil is adjusted so the composition totals 100%.

EXAMPLE 7

The components of Example 6 except that the oil is the lubricating oil of Example 3, and the overbased composition (d) comprises about 53% magnesium overbased salt of branched chain monoalkyl substituted benzenesulfonic acids, molecular weight about 500, metal ratio 2.8, about 19% calcium overbased salt of branched chain monoalkyl sulfonates, molecular weight about 500, metal ratio 1.2, about 15% magnesium overbased salt of the same branched chain sulfonates, metal ratio about 15, about 5% calcium overbased salt of the same branched chain sulfonates, metal ratio 11, and about 8% sodium overbased salt of straight and branched chain dialkylsulfonates, molecular weight about 385, metal ratio 20; and further including (f) 1.8 weight percent of the dithiophosphate diester from isopropyl and 4-methyl-2-pentyl alcohols, neutralized with zinc oxide.

EXAMPLE 8

The components of Example 6 except that the active ingredient of the overbased composition (d) is a mixture of 60 weight percent the sodium overbased carbonate salt of alkyl carboxylates having a chain length of about 18 carbon atoms and 40 weight percent the magnesium over-based carbonate salt of $C_9$-alkyl phenates.

EXAMPLE 9

The components of Example 7 except that component (ii) is used in an amount of 10 weight percent, and that component is supplied as a composition containing approximately 50 weight percent active ingredient and about 50 weight percent diluent oil, resulting in a concentration of about 5 weight percent active component, the amount of component (b) is 1.7 weight percent and that component is supplied as 62% active ingredient with 38% diluent oil, the amount of component (c) is 3.1 weight percent, the amount of component (d) is 3.9 weight percent, component (e) is 4.0 weight percent polyisobutylene succinimide from polyisobutylene (1 mole) and succinic anhydride (2 moles), mw 2000, reacted with polyethyleneamines, CO:N mole ratio 6:5, 45% active ingredient, 55% diluent oil;

component (f) is present at 1.2 weight percent;

and further including components (g) 0.3 weight percent mixed mono- and dialkylated ($C_9$) diphenylamines (including 16% diluent oil);

(h) 0.2 weight percent sulfurized butyl cyclohexene carboxylate, mole ratio olefin:sulfur about 1:1 (including 5% diluent oil);

(i) 0.15 weight percent oleamide, $C_{17}H_{33}CONH_2$; and (j) less than 0.1 weight percent each of other additives including silicone antifoam agent and pour point depressant.

EXAMPLE 10

The components of Example 9 except that component (ii) is a copolymer of ethylene and propylene grafted with maleic anhydride, the grafted anhydride comonomer being further reacted with 6-aminodiphenylamine (1:1 mole ratio of anhydride to the diphenylamine).

EXAMPLE 11

The components of Example 9 except that overbased component (d) is 3.0 weight percent of the component (d) from Example 7, absent the sodium overbased salt of straight and branched chain dialkylsulfonates, and 0.8 weight percent of the component (d) from Example 8.

EXAMPLE 12

The components of Example 1 except that component (a) is tolyltriazole and is present in an amount of about 0.1 weight percent.

EXAMPLE 13

The components of Example 6 except that component (a) is a tolytriazole amine salt of the structure:

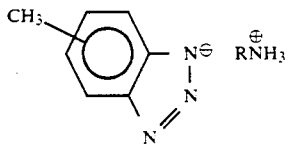

where R = oleyl.

EXAMPLE 14

The components of Example 9 except that component (a) is the condensate of tolyltriazole with formaldehyde and tridecyl alcohol in a 1:1:1 mole ratio, having the formula

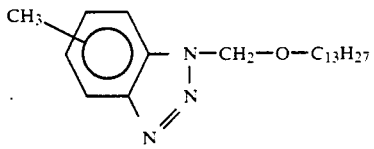

Each of the documents referred to above is incorporated herein by reference. As used herein, the expression "consisting essentially of" permits the inclusion of small amounts of substances which do not materially affect the basic and novel characteristics of the composition under consideration.

What is claimed is:

1. A lubricant composition comprising a major proportion of an oil of lubricating viscosity, a minor proportion of a multifunctional olefin copolymer viscosity index modifier, and a minor proportion of an additive composition comprising:

(a) about 0.001 to about 1 percent by weight of the lubricant composition of a benzotriazole substituted on a nitrogen atom by reacting the benzotriazole with an aldehyde and a primary or secondary amine or an alcohol and (b) about 0.5 to about 5 percent by weight of the lubricant composition of the reaction product of a hydrocarbylsubstituted acylating agent, a polyamine, and a boron compound.

2. The composition of claim 1 wherein the olefin copolymer is a copolymer of ethylene and propylene grafted with a monomer which imparts dispersant and antioxidant properties.

3. The composition of claim 2 wherein the comonomer is a nitrosodiarylamine.

4. The composition of claim 1 wherein the benzotriazole is substituted on the benzene ring by a hydrocarbyl substituent.

5. The composition of claim 7 wherein the benzotriazole is reacted with the aldehyde and a primary or secondary amine.

6. The composition of claim 1 wherein the triazole of (a) is

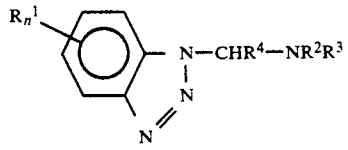

wherein $R^1$ is a hydrocarbyl group, n is 0 to 4, provided that if n is greater than 1 not all such hydrocarbyl groups need be identical, $R^2$ and $R^3$ are hydrogen or alkyl, provided that both $R^2$ and $R^3$ are not hydrogen, and $R^4$ is hydrogen or an alkyl group of 1 to 6 carbon atoms.

7. The composition of claim 6 wherein n is 1 and $R^1$ is methyl.

8. The composition of claim 6 wherein $R^2$ and $R^3$ are 2-ethylhexyl.

9. The composition of claim 1 wherein $R^4$ is hydrogen.

10. The composition of claim 1 wherein the acylating agent is a succinic acylating agent.

11. The composition of claim 10 wherein the succinic acylating agent is succinic anhydride.

12. The composition of claim 1 wherein (a) is the reaction product of tolyltriazole, formaldehyde, and di-2-ethylhexylamine.

13. The composition of claim 1 wherein the hydrocarbyl substituent in (b) is a $C_8$ to $C_{500}$ alkyl group or mixtures of such alkyl groups.

14. The composition of claim 13 wherein the hydrocarbyl substituent is an isobutylene or propylene oligomer.

15. The composition of claim 1 wherein the hydrocarbyl substituent in (b) contains on average 3 to 4 monomer units.

16. The composition of claim 8 wherein the hydrocarbyl substituent has a molecular weight of about 500 to about 2000.

17. The composition of claim 16 wherein the hydrocarbyl substituent is an isobutylene polymer.

18. The composition of claim 1 wherein the polyamine is a polyethylene polyamine.

19. The composition of claim 18 wherein the polyethylene polyamine is a mixture of components having on the average about 3 to about 10 ethylene amine units.

20. The composition of claim 1 wherein the boron compound of component (b) is boric acid.

21. The composition of claim 20 wherein the components of (b) are present in relative amounts of about 3–5 moles carbonyl group, about 2–8 moles amino group, and about 2–8 moles boric acid.

22. The composition of claim 21 wherein the components of (b) are present in relative amounts of about 3–5 moles carbonyl group, about 2–4 moles amino group, and about 2–4 moles boric acid.

23. The composition of claim 1 wherein (a) and (b) are present in the ratio of about 1:3 to about 1:120 by weight.

24. The composition of claim 23 wherein (a) and (b) are present in the ratio of about 1:12 to about 1:30 by weight.

25. The composition of claim 7 wherein the amount of component (a) is about 0.01 to about 0.2 weight percent and the amount of component (b) is about 0.3 to about 3 weight percent.

26. The composition of claim 25 wherein the amount of component (a) is about 0.03 to about 0.07 weight percent and the amount of component (b) is about 0.6 to about 1.5 weight percent.

27. The composition of claim 1 wherein the multifunctional olefin copolymer viscosity index modifier and the additive composition of (a) plus (b) are present in the relative amounts of about 1:2 to about 25:1 by weight.

28. The lubricant composition of claim 1 wherein the weight ratio of component (a) to component (b) is about 1:3 to about 1:120 and wherein the weight ratio of the multifunctional olefin copolymer viscosity index modifier to the total of components (a) and (b) is about 1:2 to about 25:1.

29. The lubricant composition of claim 1 wherein the benzotriazole (a) is the reaction product of benzotriazole or an alkylbenzotriazole having an alkyl group of 1 to 8 carbon atoms, an aldehyde of 1 to about 12 carbon atoms, and a secondary amine; the amount of the benzotriazole product (a) is about 0.01 to about 0.2 weight percnet; and the amount of the product of (b) is about 0.3 to about 3 weight percent.

30. The lubricant composition of claim 1 wherein the benzotriazole (a) is the reaction product of tolyltriazole, formaldehyde, and di-2-ethylhexylamine; the amount of the benzotriazole product (a) is about 0.03 to about 0.07 weight percent; and the amount of the product of (b) is about 0.6 to about 1.5 weight percent.

31. A concentrate comprising a concentrate-forming proportion of an oil of lubricating viscosity, a multifunctional olefin copolymer viscosity index modifier, and an additive composition comprising:

(a) a benzotriazole substituted on a nitrogen atom by reacting the benzotriazole with an aldehyde and a primary or secondary amine or an alcohol and (b) the reaction product of a hydrocarbyl-substituted acylating agent, a polyamine, and a boron compound wherein (a) and (b) are present in the ratio of about 1:3 to about 1:120 by weight.

* * * * *